United States Patent [19]

Umeya et al.

[11] 3,941,960

[45] Mar. 2, 1976

[54] VACUUM POWER CIRCUIT BREAKER

[75] Inventors: Eiji Umeya; Hifumi Yanagisawa, both of Tokyo, Japan

[73] Assignee: Kabushiki Kaisha Meidensha, Tokyo, Japan

[22] Filed: Apr. 1, 1974

[21] Appl. No.: 457,137

[30] Foreign Application Priority Data

Apr. 2, 1973 Japan ..... 48-39911[U]

[52] U.S. Cl. ..... 200/144 B

[51] Int. Cl.[2] ..... H01H 33/66

[58] Field of Search ..... 200/144 B

[56] References Cited

UNITED STATES PATENTS

| | | | |
|---|---|---|---|
| 3,129,308 | 4/1964 | Yokoyama et al. | 200/144 B |
| 3,174,019 | 3/1965 | Jansson | 200/144 B |
| 3,555,223 | 1/1971 | Robinson et al. | 200/144 B |

*Primary Examiner*—Robert S. Macon

*Attorney, Agent, or Firm*—Haseltine, Lake & Waters

[57] ABSTRACT

A vacuum power circuit breaker having a vacuum-bulb interrupter unit comprising a vacuum bulb consisting of a cylindrical insulating envelope and end plates attached to the axial ends of the insulating envelope, stationary and movable electrode rods projecting into the vacuum bulb through the end plates, and metallic bellows assemblies connecting the stationary and movable electrode rods to the associated end plates of the vacuum bulb. Not only the movable electrode rod but the stationary electrode rod is thus axially movable relative to the vacuum bulb so that an impact applied to the stationary electrode rod when the movable electrode rod is connected to the stationary electrode rod is absorbed by the stationary electrode rod itself. The stationary electrode rod is held fixed independently of the vacuum bulb to prevent the electrode rod from being moved away from the movable electrode rod when the latter is moved and connected to the former. Means are provided for the purpose of preventing relative rotation between the electrode rods and the vacuum bulb so that the bellows assemblies are protected from being distorted when the stationary electrode rod is fixed to a stationary member.

6 Claims, 5 Drawing Figures

VACUUM POWER CIRCUIT BREAKER

The present invention relates to power circuit breakers and, more particularly, to vacuum power circuit breakers.

The vacuum power circuit breakers are used principally for polyphase medium-voltage power distribution purposes and comprise vacuum-bulb power interrupter units which are respectively allocated to individual phases of the current to be cut off. Each of the interrupter units has a vacuum bulb which is composed of a generally cylindrical insulating envelope and a pair of end plates of metal which are connected through metal-to-insulation vacuum seals to the longitudinal ends of the insulating envelope. Stationary and movable electrode rods project into the vacuum bulb through these end plates and respectively carry electrical contacts at their leading ends which are located in the vicinity of the longitudinal center of the bulb. The vacuum circuit breaker is mounted on a power distributor in such a manner that each of the interrupter units is suspended from a stationary member through its upper end plate connected to the stationary electrode rod or carried on a stationary member through its lower end plate connected to the movable electrode. When the movable electrode rod is driven to axially move for connection to the stationary electrode rod, an impact is applied to the stationary electrode rod and through the stationary electrode rod to the end plate connected to the stationary electrode rod. The impact thus imparted to the end plate of the interrupter unit is transferred to the insulating envelope to which the end plate is fixed. The insulating envelope, usually formed of glass, is susceptible to such an impact and is consequently liable to break in case the movable electrode rod happens to forcefully strike the stationary electrode rod. It has therefore been proposed to have not only the movable electrode rod but the stationary electrode rod connected to the associated end plate by means of a metallic bellows assembly so that the stationary electrode rod as well as the movable electrode rod is movable relative to the end plate and accordingly to the insulating envelope. The impact applied to the stationary electrode rod from the movable electrode rod is thus absorbed solely by the cushioning effect of the stationary electrode rod itself.

In the vacuum-bulb interrupter unit thus constructed, it is important that the stationary electrode rod be held stationary independently of the vacuum bulb so that the stationary electrode rod may not ve moved away from the movable electrode rod when the movable electrode rod is to be connected thereto. When the stationary electrode rod is adjusted for proper relative position during assemblage of the circuit breaker, a twisting motion applied to the stationary electrode rod tends to be imparted to the bellows assembly interconnecting the stationary electrode rod and the associated end plate. During use of the circuit breaker, therefore, the bellows assembly tends to be caused to expand and collapse in a distorted condition so that the service life of the bellows assembly is shortened and accordingly the reliability of the circuit breaker as a whole is critically degraded. The present invention contemplates elimination of all these problems that have been encountered in the prior art vacuum power circuit breakers of the describe character.

It is, therefore, an important object of the present invention to provide an improved vacuum power circuit breaker having means adapted to protect the insulating envelope of the vacuum-bulb interrupter unit from being damaged by an impact applied to the stationary electrode rod when the movable electrode rod is connected thereto.

It is another important object of the invention to provide an improved vacuum power circuit breaker in which not only the movable electrode rod but the stationary electrode rod is axially movable relative to the vacuum bulb of the interrupter unit of the circuit breaker so that an impact applied to the stationary electrode rod when the movable electrode rod is connected thereto is absorbed by a cushioning effect of the stationary electrode rod.

It is still another important of the present invention to provide an improved vacuum power circuit breaker in which the stationary electrode rod is fixedly supported by a support member in such a manner that the stationary electrode rod is axially movable over an appreciable distance relative to the vacuum bulb of the interrupter unit and is yet prevented from being twisted about its axis relative to the support member when the support member is fixed to a stationary member.

It is a further important object of the present invention to provide an improved power circuit breaker which is simple in construction, easy to be installed in a working position and economical to manufacture and to use.

In accordance with the present invention, these and other objects will be accomplished in a power circuit breaker having a vacuum-bulb power interrupter unit which comprises a vacuum bulb including a generally cylindrical insulating envelope and first and second end plates which are attached to longitudinal ends of the insulating envelope; a first electrode rod axially projecting into the vacuum bulb through an aperture formed in the first end plate of the vacuum bulb; a second electrode rod axially movably projecting into the vacuum bulb through an aperture in the second end plate of the vacuum bulb and extending substantially in line with the first electrode rod; the first and second electrode rods respectively carrying at their leading ends electrical contact elements which are spaced apart from each other when the second electrode rod is moved away from the first electrode rod and which are in contact with each other when the second electrode rod is moved toward the first electrode rod; a first flexible connecting member connecting the first electrode rod to the first end plate of the vacuum bulb; a second flexible connecting member connecting the second electrode rod to the second end plate of the vacuum bulb; a support member positioned over and in parallel an outer face of the first end plate of the vacuum bulb and fixedly supporting the first electrode rod thereon; the support member being formed with at least one aperture and fixedly connected to a stationary member through rigid fastening means; and at least one elongated rigid member which projects axially outwardly from the first end plate of the vacuum bulb and which is axially moveable through the aperture in the support member. If desired, the vacuum power circuit breaker may further comprise a sleeve fixedly received in the aperture in the second end plate of the vacuum bulb so that the second electrode rod is received in the sleeve in such a manner as to be axially movable in the sleeve and prevented from being rotated in the sleeve.

In this instance, the second electrode rod may be splined to the sleeve through mating axial teeth formed internally of the sleeve and externally of the second electrode rod or, otherwise, the second electrode rod may be keyed to the sleeve through an axial groove formed internally of the sleeve and a key formed externally of the second electrode rod. Where desired, moreover, a stop member may be fixed to the elongated member on the first end plate, which stop member is in abutting engagement with the outer face of the support member for limiting an axial displacement of the vacuum bulb away from the support member.

The features and advantages of the vacuum power circuit breaker according to the present invention over the prior art vacuum circuit breakers will become more apparent from the following description taken in conjunction with the accompanying drawings in which.

Figure 1:
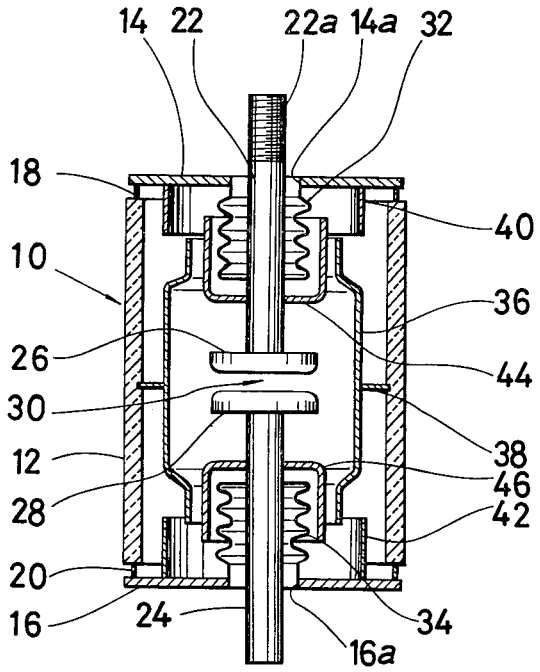
FIG. 1 PRIOR ART
FIG. 1 is a longitudinal sectional view which schematically shows a representative example of the conventional vacuum power circuit breaker.

Reference will now be made to the drawings, first to FIG. 1 for better understanding of the drawbacks inherent in the prior art vacuum power circuit breaker of the described character.

The vacuum power circuit breaker usually has a vacuum-bulb interrupter unit which comprises a vacuum bulb 10 consisting of a generally cylindrical insulating envelope 12 of glass and a pair of end plates 14 and 16 of metal. The cylindrical insulating envelope 12 is securely connected at its longitudinal ends to the end plates 14 and 16 through metal-to-insulation vacuum seals 18 and 20, respectively, so that a vacuum chamber is formed in the bulb 10. The end plates 14 and 16 are formed with central apertures **14*a* and 16*a*, respectively, through which stationary and movable electrode rods 22 and 24 project into the vacuum bulb 10. The stationary and movable electrode rods 22 and 24 are in line with each other and carry at their leading ends stationary and movable electrical contact elements 26 and 28, respectively. The movable electrode rod 24 is axially movable toward and away from the stationary electrode rod 22 so that the movable contact element 28 carried thereon is brought into contact with the stationary contact element 26 on the stationary electrode rod 22 for providing electrical connection between the two electrode rods when the movable electrode rod 24 is moved toward the stationary electrode rod 22. When, conversely, the movable electrode rod 24 is moved away from the stationary electrode rod 22, then the movable contact element 28 is spaced apart from the stationary contact element 26 so that an arcing region 30 is formed between the two contact elements 26 and 28 thereby interrupting the flow of an electric current between the electrode rods 22 and 24. The stationary and movable electrode rods 22 and 24 are connected to the associated end plates 14 and 16 by means of metallic bellows assemblies 32 and 34, respectively. Between the insulating envelope 12 and the aligned stationary and movable electrode rods 22 and 24 is concentrically positioned a generally cylindrical main arc-shield element 36 which is supported by the insulating envelope 12 through an annular support member 38. The main arc-shield element 36 has its axial ends located in the neighbourhood of the end plates 14 and 16 of the vacuum bulb 10 and a pair of generally ring-shaped auxiliary arc-shield elements 40 and 42 are connected to the end plates 14 and 16, respectively, for lessening the strength of electric field around each of the vacuum seals 18 and 20. Designated by reference numerals 44 and 46 are generally cup-shaped arc-shield elements which are supported by the stationary and movable electrode rods 22 and 24 for the protection of the bellows assemblies 32 and 34**, respectively, from arc plasma.

The vacuum-bulb power interrupter unit thus constructed is incorporated into a power distributor in such a manner that either the upper end plate 14 or the lower end plate 16 of the vacuum bulb 10 is rigidly connected through an insulation to a stationary support member (not shown) of the distributor so that the vacuum bulb 10 is suspended from or superposed on the support member. The stationary electrode rod 22 is electrically connected to a leading-in power line (not shown) whereas the movable electrode rod 24 is electrically connected to a leading-out power line (not shown) and is mechanically connected to an actuating member of a suitable control mechanism (not shown) using, for example, a solenoid and/or spring arrangement as is well known in the art.

When, thus, the movable electrode rod 24 is axially moved toward the stationary electrode rod 22 by means of the control mechanism for establishing electrical connection between the two electrode rods, an impact is exerted on the stationary electrode rod 22. The impact is, however, isolated from the end plate 14 and accordingly from the insulating envelope 12 of glass because the stationary electrode rod 22 is arranged to be axially movable relative to the vacuum bulb 10 through the bellows assembly 32. The impact exerted on the stationary electrode rod 22 is thus absorbed by the stationary electrode rod itself 22 so that the insulating envelope 12 formed of the fragile material such as glass is protected from being ruptured.

In order that the stationary electrode rod 22 is prevented from being moved away from the movable electrode rod 24 when the movable electrode rod 24 is connected to the stationary electrode rod 22, it is required that the stationary electrode rod 22 be fixed independently of the vacuum bulb 10 to a suitable stationary member (not shown) by means, for example, of a screw **22*a* formed on an outer end portion of the stationary electrode rod 22. As noted previously, a twisting motion is imparted to the stationary electrode rod 22 and accordingly to the associated bellows assembly 32 when the stationary electrode rod 22 is being fixed to the support member during assemblage, causing the bellows assembly 32 to be distorted about its axis. When the bellows assembly 32 is collapsed and expanded in such a distorted condition, an undue stress is produced therein and as a consequence the service life of the bellows assembly 32 tends to be shortened and accordingly the reliability of the interrupter unit as a whole is deteriorated during use. The principal goal of the present invention is to provide means capable of preventing the stationary electrode rod 22 from being rotated about its axis when the electrode rod 22 is fixed to the stationary support member so as to prolong the service life of the bellows assembly 32** and accordingly to enhance the reliability of the vacuum power circuit breaker of the described character.

Figure 2:
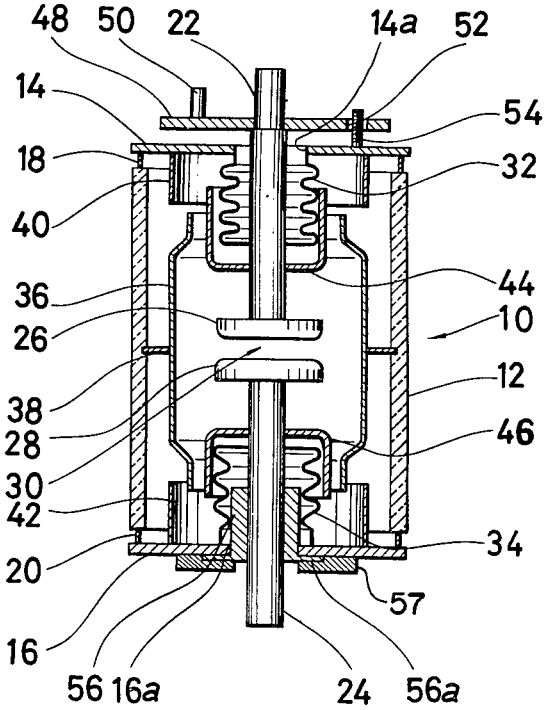
FIG. 2 is a view similar to FIG. 1 but schematically shows a preferred embodiment of the vacuum power circuit breaker according to the present invention.

Referring to FIG. 2, the vacuum-bulb interrupter unit of the vacuum power circuit breaker embodying the present invention is shown to be constructed generally similarly to the interrupter unit illustrated in FIG. 1. In FIG. 2, therefore, the parts and elements corresponding to those of the interrupter unit shown in FIG. 1 are designated by like reference numeral. The description made in respect of the interrupter unit illustrated in FIG. 1 thus applies as it is to the construction of the interrupter unit shown in FIG. 2. It is, however, to be noted that the arc-shield arrangement incorporated into the interrupter herein shown is merely for the purpose of illustration and may be modified in numerous manners.

Figure 3:
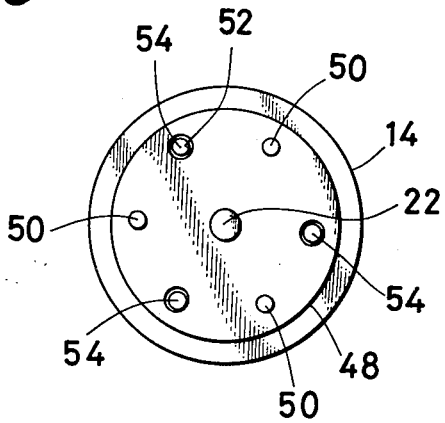
FIG. 3 is a top end view of the power circuit breaker illustrated in FIG. 2.

The stationary electrode rod 22 is fixedly connected at its outer end portion to a support member 48 which is positioned over the upper end plate 14 of the vacuum bulb 10. The support member 48, which is shown in a circular disc form with in FIG. 3, is formed a plurality of projections 50 on the outer face of the member 48 and with and a plurality of apertures 52. As seen in FIG. 3, the projections 50 and the apertures 52 are arranged substantially symmetrically with respect to the center of the support member 48, viz., to an axis of the vacuum bulb 10. The end plate 14 of the vacuum bulb 10 has fixed secured to the outer face thereof a plurality of elongated rigid members or pins 54 which are respectively axially movably received in the apertures 52 in the support member 48. The projections 50 of the support member 48 are threaded to form screw portions and, through these screw portions, fastened to a stationary member or structure (not shown) forming part of the power distributor. A flanged sleeve 56 is received in the central aperture **16*a* in the lower end plate 16 of the vacuum bulb 10 and is securely connected to the end plate 16 through its flange portion 56*a* and a mounting plate 57 attached to the outer or lower face of the end plate 16. The movable electrode rod 24 is splined to the sleeve 56 through axial external teeth formed on the movable electrode rod 24 and corresponding axial internal teeth formed on the sleeve 56 so that the electrode rod 24 and the sleeve 56 are allowed to be axially moved relative to each other but relative rotation between the electrode rod 24 and the sleeve 56 is prevented. It is, in this instance, apparent that the splined connection between the movable electrode rod 24 and the sleeve 56** can be replaced with a connection using a key and an axial groove engaging the key.

Figure 4:
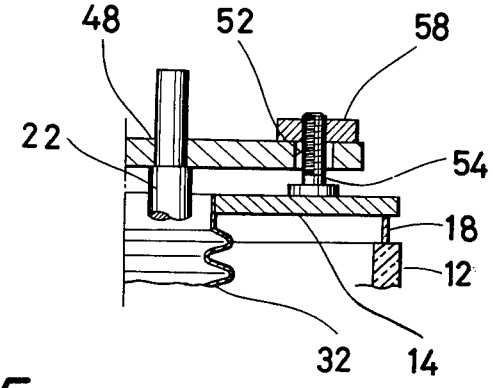
FIG. 4 is a fragmentary sectional view which shows, to an enlarged scale, details of a modification of the vacuum power circuit breaker illustrated in FIGS. 2 and 3.
Figure 5:
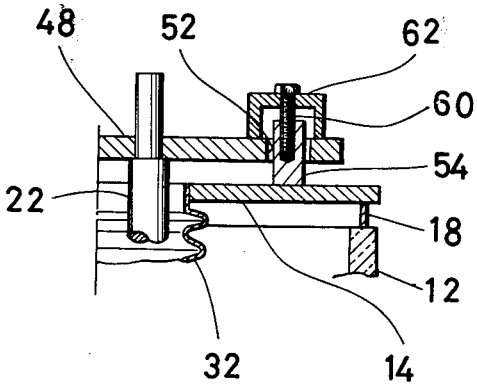
FIG. 5 is a view similar to FIG. 4 but shows another modification of the embodiment illustrated in FIGS. 2 and 3.

Since, in the interrupter unit above described, the stationary electrode rod 22 is fixedly connected to the stationary member or structure through the threaded projections 50 of the support member 48 secured to the electrode rod 22, the stationary electrode rod 22 is prevented from being axially moved relative to the stationary member or structure although the same is allowed to axially move relative to the vacuum bulb 10 because the pins 54 on the end plate 14 of the vacuum bulb 10 are axially movable through the apertures 52 in the support member 48. Due to the engagement between the end plate 14 and the support member 48 through the pins 54 on the end plate and the apertures 52 in the support member, moreover, relative rotation is prevented between the end plate 14 and the support member 48 and accordingly between the vacuum bulb 10 and the stationary electrode rod 22. The engagement between the end plate 14 and the support member 48 through the pins 54 and the apertures 52 is also effective to prevent lateral movement of the stationary electrode rod 22 relative to the vacuum bath 10. Thus, no twisting motion is imparted to the stationary electrode 22 and accordingly to the vacuum bulb 10 when the support member 48 is secured to the stationary member or structure through the threaded projections 50 of the support member 48 so that the bellows assembly 32 interconnecting the end plate 14 and the stationary electrode rod 22 is prevented from being twisted and distorted. Through provision of the sleeve 56 splined or keyed to the movable electrode rod 24, furthermore, the movable electrode rod 24 is also prevented from being turned relative to the vacuum bulb 10 so that the bellows assembly 34 associated with the movable electrode rod 24 can be prevented from being twisted and distorted even though a torque may be imparted to the movable electrode rod 24.

Where desired, each of the pins 54 on the end plate 14 may be externally threaded and screwed to a stop member 58 which is in tightly abutting engagement with the outer or upper face of the support member 48 as illustrated in FIG. 4. The stop members 58 thus connected to the pins 54 on the end plate 14 will be conducive to preventing the stationary electrode rod 22 from being axially inwardly moved relative to the vacuum bulb 10 when an external force happens to be applied to the stationary electrode 22 and/or the support member 48 during, for example, assemblage, storage or haulage of the interrupter unit. Similar results will be achieved if, as illustrated in FIG. 5, each of the pins 54 on the end plate 14 is internally threaded and engaged by a bolt 60 and a stop member 62 is tightened against the outer or upper face of the support member 48 by means of the bolt 60.

It will now be appreciated from the foregoing description that the vacuum power circuit breaker according to the present invention is characterized in that the bellows assemblies 32 and 34 connected to the stationary and movable electrode rods 22 and 24, respectively, are prevented from unduly distorted during operation or during handling for assemblage or transportation so that the performance quality of the power circuit breaker can be maintained throughout a prolonged use of the circuit breaker. Since, moreover, the mechanism to prevent the relative rotation of the stationary electrode rod 22 is mounted on a fixed side of the interrupter unit, no such an arrangement need be provided as will movably hold the movable electrode rod. This will provide simplicity of construction of the interrupter unit and ease of installation in the power distributor.

What is claimed is:

1. In a vacuum power circuit breaker including a generally cylindrical vacuum bulb having first and second end plates formed with respective openings which are substantially aligned with each other, first and second electrode rods axially projecting into said vacuum bulb respectively through said openings in the first and second end plates and carrying respective electrical contact elements at their leading ends, said second electrode rod being axially movable toward and away from said first electrode rod for moving the contact element on the second electrode rod into and out of engagement with the contact element on the first electrode rod, first and second flexible connecting members respectively providing sealed connections between said first end plate and said first electrode rod and between said second end plate and said second electrode rod, and a stationary support member positioned over the outer face of said first end plate and having said first electrode rod fixedly secured thereto so that said vacuum bulb is entirely movable relative to said support member and to said first electrode rod, the improvement comprising means for preventing said vacuum bulb from rotating about its axis relative to said support member while allowing the vacuum bulb to axially move relative to the support plate, said means comprising a portion of said support member, said portion being formed with at least one aperture located over the outer face of said first end plate of said vacuum bulb, and at least one rigid, elongated member fixedly mounted on said first end plate and extending from the outer face of said first end plate parallel with the axis of said vacuum bulb, said elongated member being axially movable through said aperture so that said first end plate is allowed to move relative to said support member in axial direction of said vacuum bulb while being prevented from rotating relative to said support plate about the axis of said vacuum bulb.

2. The improvement as set forth in claim 1, wherein said means further comprise an internally splined tubular member fixedly mounted on said second end plate through the opening formed therein and having a longitudinal axis in line with the axis of said second electrode rod, and external splines formed on said second electrode rod and in mating engagement with the internal splines of said tubular member so that the vacuum bulb is axially movable relative to the second electrode rod, while being prevented from being rotated about its axis relative to the second electrode rod.

3. The improvement as set forth in claim 1, wherein said portion of said support plate is formed with a plurality of apertures located over the outer face of said first end plate and said means comprise a plurality of rigid elongated members fixedly mounted on said first end plate and extending from the outer face of said first end plate parallel with the axis of said vacuum bulb, said elongated members being axially movable respectively through said apertures.

4. The improvement as set forth in claim 3, wherein said apertures and said elongated members are arranged substantially symmetrically around the center axis of said vacuum bulb.

5. The improvement as set forth in claim 1, wherein said means further comprise a stop member fixed to the free end of said elongated member projecting out of said aperture in said support member, said stop member being engaged by the support member when said vacuum bulb is axially moved away from said support plate.

6. The improvement as set forth in claim 5, wherein said elongated member is connected to said stop member by an adjustable member for adjusting the spacing between the outer face of said first end plate and said stop member.

* * * * *